US010801778B2

(12) United States Patent
Haines et al.

(10) Patent No.: US 10,801,778 B2
(45) Date of Patent: Oct. 13, 2020

(54) BATCH CHARGE CONVEYING SYSTEMS FOR ELECTRIC INDUCTION FURNACES

(71) Applicant: INDUCTOTHERM CORP., Rancocas, NJ (US)

(72) Inventors: Ted Haines, Westampton, NJ (US); Satyen N. Prabhu, Voorhees, NJ (US); Nikita Skorodinski, Philadelphia, PA (US)

(73) Assignee: INDUCTOTHERM CORP., Rancocas, NJ (US)

( * ) Notice: Subject to any disclaimer, the term of this patent is extended or adjusted under 35 U.S.C. 154(b) by 0 days.

(21) Appl. No.: 15/215,019

(22) Filed: Jul. 20, 2016

(65) Prior Publication Data

US 2017/0030648 A1 Feb. 2, 2017

Related U.S. Application Data

(60) Provisional application No. 62/198,180, filed on Jul. 29, 2015.

(51) Int. Cl.

| | |
|---|---|
| ***F27D 3/06*** | (2006.01) |
| ***F27D 3/00*** | (2006.01) |
| ***F27D 11/06*** | (2006.01) |

(52) U.S. Cl.

CPC ..... *F27D 3/06* (2013.01); *F27D 3/0025* (2013.01); *F27D 3/0031* (2013.01); *F27D 11/06* (2013.01); *F27D 2003/006* (2013.01); *F27D 2003/0038* (2013.01); *F27D 2003/0062* (2013.01)

(58) Field of Classification Search

CPC ..... F27D 3/06; F27D 3/0025; F27D 3/0031; F27D 11/06; F27D 2003/0038; F27D 2003/006; F27D 2003/0062

See application file for complete search history.

(56) References Cited

U.S. PATENT DOCUMENTS

| | | | | | |
|---|---|---|---|---|---|
| 2,812,866 | A | * | 11/1957 | Whitehouse | C21C 5/527 414/181 |
| 3,146,901 | A | * | 9/1964 | McDowell | C21C 5/466 414/192 |
| 4,537,551 | A | * | 8/1985 | Krogsrud | F27D 3/0025 414/199 |
| 4,579,524 | A | * | 4/1986 | Kraus | C21C 5/466 266/901 |
| 4,694,465 | A | * | 9/1987 | Nanjo | C21C 5/527 373/81 |
| 4,836,732 | A | * | 6/1989 | Vallomy | C21C 5/527 414/188 |
| 4,921,521 | A | * | 5/1990 | Kremenets | C03B 3/02 65/135.8 |

(Continued)

FOREIGN PATENT DOCUMENTS

JP H07-257707 A 10/1995

*Primary Examiner* — Kaitlin S Joerger

(74) *Attorney, Agent, or Firm* — Philip O. Post

(57) ABSTRACT

A batch charge conveying system is provided for multiple electric induction furnaces where each one of the multiple furnaces has a separate charge conveying apparatus. An assembled batch charge is loaded on a single assembled batch charge transport apparatus that selectively delivers the assembled batch charge to a separate charge conveying apparatus associated with one of the multiple electric induction furnaces.

9 Claims, 4 Drawing Sheets

(56) References Cited

U.S. PATENT DOCUMENTS

| | | | | |
|---|---|---|---|---|
| 4,996,402 | A * | 2/1991 | Hashida | C21C 5/5241 219/634 |
| 5,350,295 | A * | 9/1994 | Kenji | B65G 37/02 432/121 |
| 6,074,204 | A | 6/2000 | Audebert et al. | |
| 6,136,064 | A * | 10/2000 | Newcomb | C22B 7/003 266/901 |
| 6,155,765 | A * | 12/2000 | Warnix | F27B 3/18 373/81 |
| 6,371,718 | B1 * | 4/2002 | Foster | B65D 88/56 294/68.26 |
| 6,712,576 | B2 * | 3/2004 | Skarzenski | C03B 3/00 414/157 |
| 6,953,337 | B2 * | 10/2005 | McCaffrey | C21B 13/0086 373/79 |
| 2012/0187105 | A1 | 7/2012 | Parks et al. | |
| 2013/0211581 | A1 | 8/2013 | Assante et al. | |
| 2014/0166116 | A1 * | 6/2014 | Tockert | C21B 7/24 137/14 |
| 2015/0159952 | A1 | 6/2015 | Qi et al. | |
| 2015/0159954 | A1 * | 6/2015 | Font Puig | F27B 3/065 266/44 |
| 2017/0232507 | A1 * | 8/2017 | Nishida | B22D 41/12 266/44 |

* cited by examiner

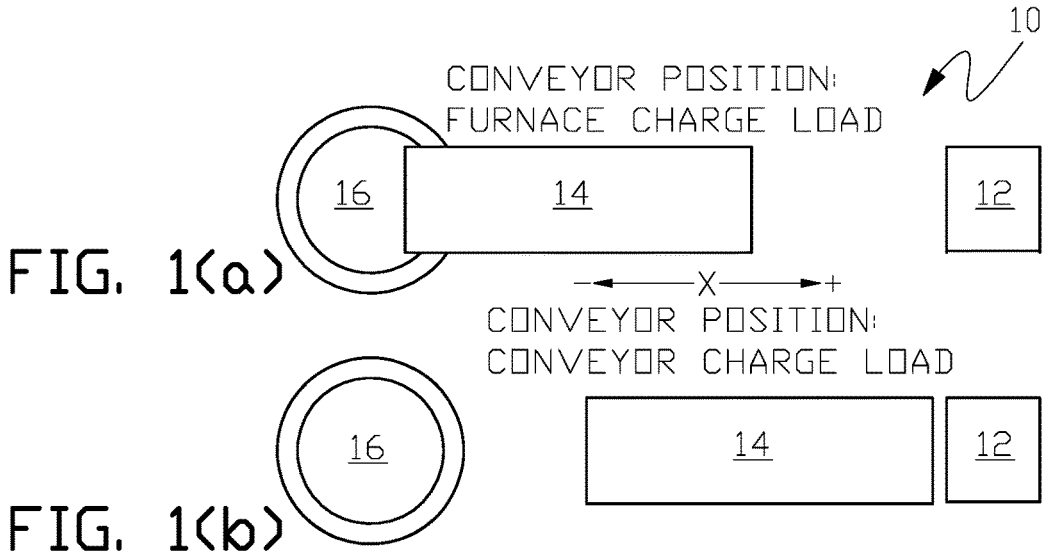
FIG. 1(a)
FIG. 1(b)
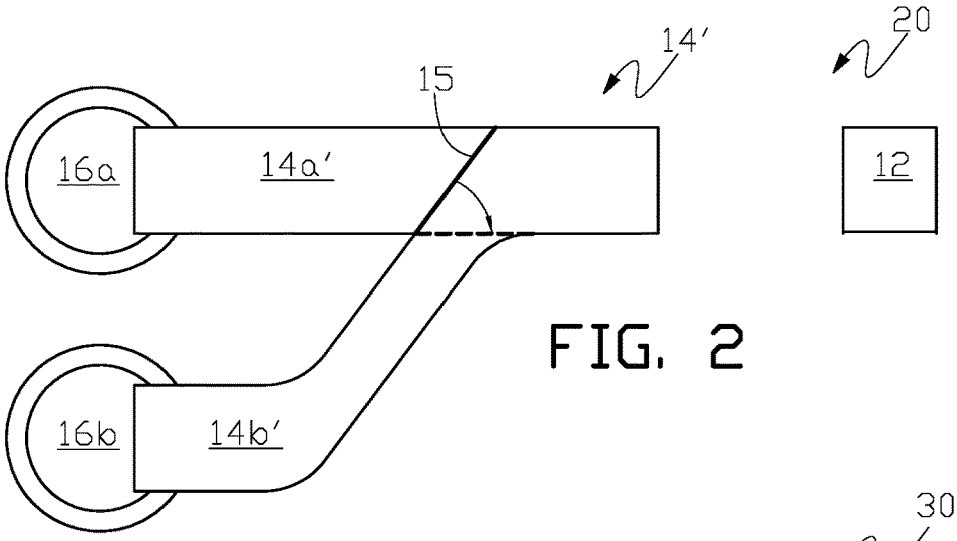
FIG. 2
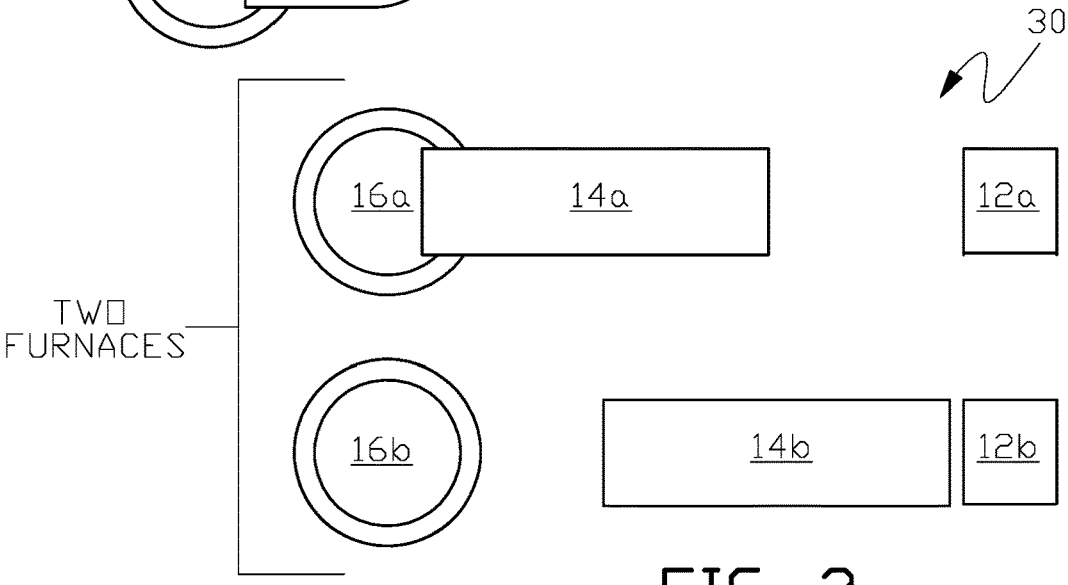
FIG. 3
PRIOR ART

BATCH CHARGE CONVEYING SYSTEMS FOR ELECTRIC INDUCTION FURNACES

CROSS REFERENCE TO RELATED APPLICATIONS

This application claims the benefit of U.S. Provisional Application No. 62/198,180, filed Jul. 29, 2015, which is hereby incorporated by reference in its entirety.

FIELD OF THE INVENTION

The present invention relates generally to batch charge conveying systems for electric induction furnaces and in particular to such batch charge conveying systems where a furnace batch charge can be selectively supplied to two or more electric induction furnaces.

BACKGROUND OF THE INVENTION

Batch melting in an electric induction furnace is a process in which the furnace is emptied of molten metal (melt) after a supplied batch of solid metal charge has been melted and heated to a required temperature. Successive melts are started by delivering unheated or preheated solid charge materials to the furnace and repeating the melting and melt heating process before drawing the melt from the furnace. Preferable batch charge conveying systems quickly deliver batch charge material (load) to an induction furnace to allow maximum utilization of the induction furnace heating and melting process. One class of charge conveying systems utilizes conveyors, such as belt or vibratory conveyors (referred to herein as charge conveying apparatus) to deliver batch charge materials to the crucible of the induction furnace. With a belt conveyor the assembled batch charge travels along the conveyor to the furnace on a moving belt. With a vibratory conveyor the assembled batch charge travels along a vibrating surface designed to advance the assembled batch charge to the furnace. Examples of vibratory conveyors are provided in U.S. Pat. Nos. 5,213,200 and 6,041,915.

One example of an in-line batch charge conveyor system 10 is illustrated in FIG. 1(*a*) and FIG. 1(*b*) where a stationary batch charge assembly station 12 feeds an assembled solid batch charge to charge conveying apparatus 14 that deposits the assembled solid batch charge to the crucible of single induction furnace 16 for electric induction melting and melt heating to a required temperature with subsequent drawing of the melt from the furnace, for example, by pouring into an assembly line of molds or a launder system. The assembled batch charge consists of selected solid charge materials that are controlled by weight and/or chemical composition to ensure that the assembled batch charge conveyed to induction furnace 16 will produce a desired quantity and/or chemical composition of molten material (metal, alloy or other material) in the furnace. The selected charge materials are delivered to the batch charge assembly station by suitable material handling and transfer apparatus, for example, a charge material conveyor upon which measured portions of different charge materials are deposited at different charge material storage stations and delivered to the batch charge assembly station. The charge conveying apparatus can be, for example, a bidirectional (+/−X-direction in FIG. 1(*a*)) moveable conveying apparatus where the conveying apparatus has a furnace charge load position as illustrated in FIG. 1(*a*) for depositing the assembled batch charge on the conveyor apparatus to the crucible of induction furnace 16 and a conveyor charge load position as illustrated in FIG. 1(*b*) with the left end of the conveying apparatus retracted from induction furnace 16, for example, to make space available for other furnace servicing equipment, and the right end of the conveying apparatus is positioned adjacent to stationary batch charge assembly station 12 for transfer of the assembled batch charge from the stationary batch charge assembly station to conveying apparatus 14. Conveying apparatus 14 then moves the assembled batch charge from the right end of the conveying apparatus to the left end of the conveying apparatus, for example, by a belt or vibratory conveyor along the length (X-direction) of the conveying apparatus to the crucible of induction furnace 16 when conveying apparatus 14 is in the furnace charge load position shown in FIG. 1(*a*). Movement of conveying apparatus 14 between the furnace charge load position in FIG. 1(*a*) and the conveyor charge load position in FIG. 1(*b*) can be accomplished by any suitable means.

As shown in the alternative arrangement of FIG. 2 charge conveying apparatus 14' may be provided with switchable multiple conveyor lanes 14*a*' and 14*b*', for example, by a vibratory conveyor with moveable conveyor gate 15 to direct the assembled batch charge to furnace 16*b* when the gate is in the position shown in a solid line, and to furnace 16*a* when gate 15 is rotated in the direction indicated by the arrow to the position shown in a dashed line. As with the example in FIG. 1(*a*) and FIG. 1(*b*) charge conveying apparatus 14' can travel between the furnace charge load position shown in FIG. 2 where an assembled batch charge loaded onto the conveying apparatus can be delivered to the selected furnace and the conveyor charge load position (not shown in the drawings) where an assembled batch charge can be transferred from the stationary batch charge assembly station 12 to conveying apparatus 14'.

In other arrangements where there are multiple induction furnaces, for example, a quantity of two furnaces 16*a* and 16*b* in a foundry as shown in FIG. 3, separate dedicated stationary batch charge assembly stations 12*a* and 12*b* are provided for each of the two induction furnaces 16*a* and 16*b*. This arrangement is inefficient since, for example, furnace batch charging in multiple furnace installations can be alternated, for example, with melting and melt heating of the supplied batch charge in the first induction furnace being performed while the second induction furnace has finished drawing molten material and is ready to receive another assembled batch charge for melting and melt heating. In the arrangement of FIG. 3 one of the two stationary batch charge assembly station can be idle (for the induction furnace currently in the batch charge melting and melt heating or drawing process) and not being used.

It is an object of the present invention to eliminate the inefficiency, and the cost, of multiple batch charge assembly stations when multiple batch melting induction furnaces require batch charge loading, for example, in a foundry installation.

BRIEF SUMMARY OF THE INVENTION

In one aspect the present invention is apparatus for, and method of, delivering an assembled batch charge from a single assembled batch charge transport apparatus selectively between two or more electric induction furnaces.

In another aspect the present invention is apparatus for, and method of, delivering an assembled batch charge from a single assembled batch charge transport apparatus selectively between two or more electric induction furnaces where each furnace is supplied with an assembled batch charge via a separate conveying apparatus dedicated to each one of the two or more electric induction furnaces.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims.

FIG. 1(*a*) and FIG. 1(*b*) diagrammatically illustrate one example of an in-line batch charge conveying system where a single stationary batch charge assembly station serves a single electric induction furnace via a charge conveying apparatus.

FIG. 2 diagrammatically illustrates one example of a single stationary batch charge assembly apparatus selectively servicing one of two electric induction furnaces via a switchable conveying system supplying an assembled batch charge selectively to one of the two furnaces by switching of the conveying path leading to one of the two furnaces.

FIG. 3 diagrammatically illustrates another example of a batch charge conveying system supplying an assembled batch charge to each one of two induction furnaces where each of the two induction furnaces has a dedicated batch charge assembly station.

DETAILED DESCRIPTION OF THE INVENTION

Figure 4A:
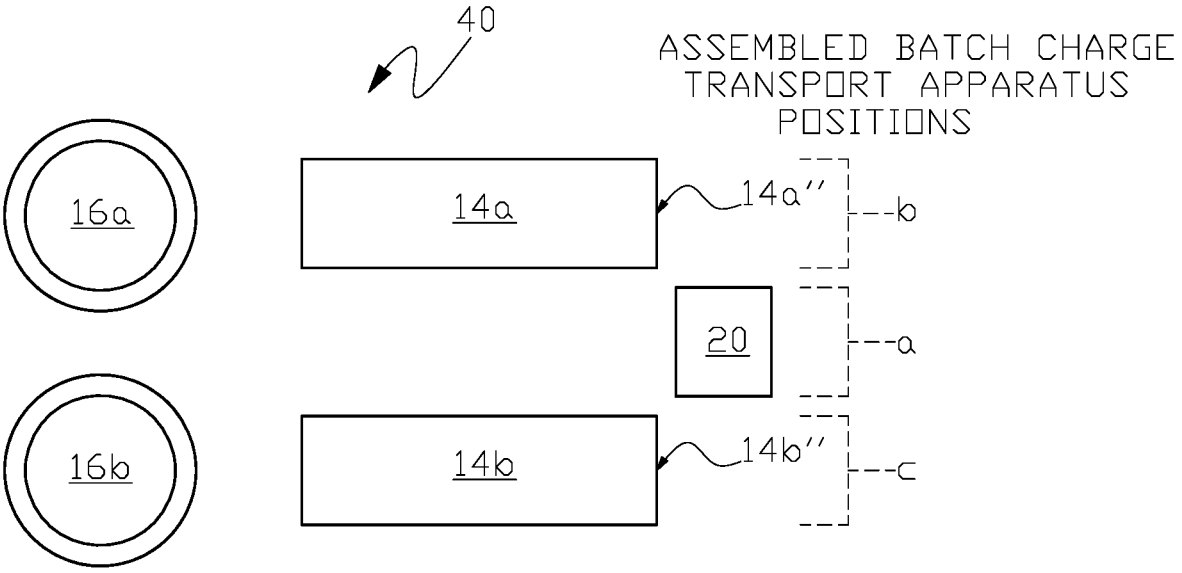
FIG. 4(*a*) through FIG. 4(*e*) diagrammatically illustrate one example of a batch charge conveying system of the present invention where a single assembled batch charge transfer apparatus selectively supplies an assembled batch charge to any one of two induction furnaces.
Figure 4B:
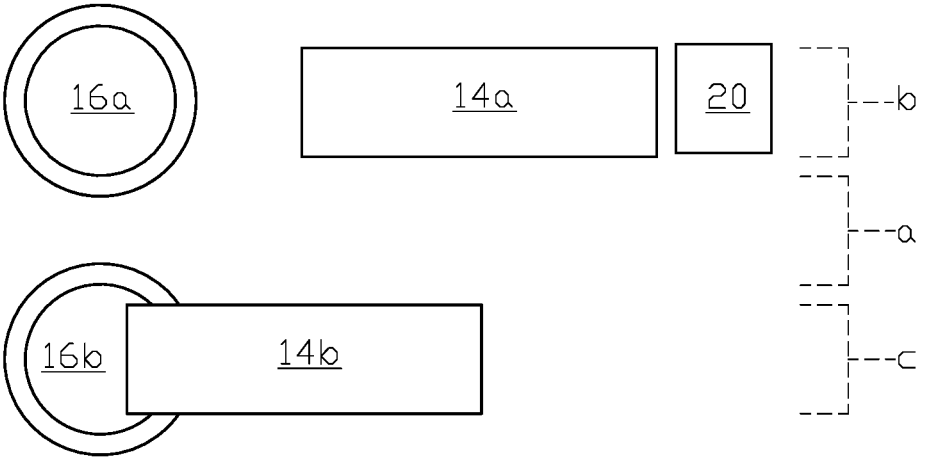
Figure 4C:
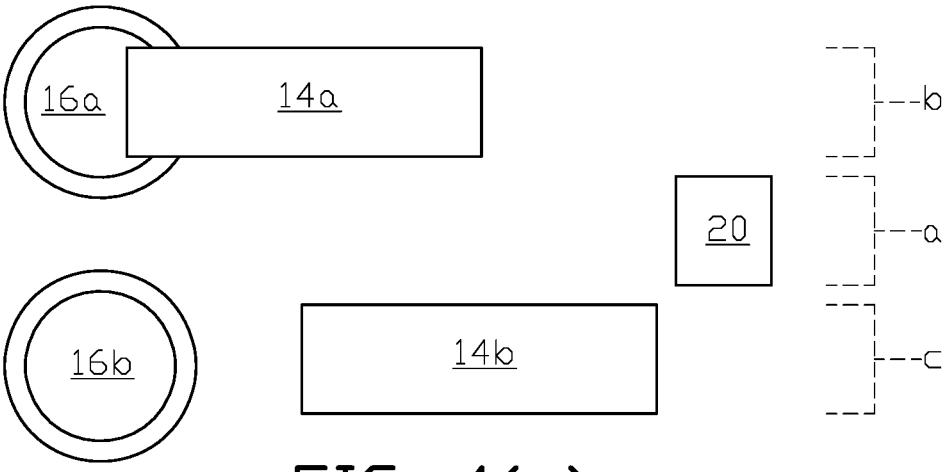
Figure 4D:
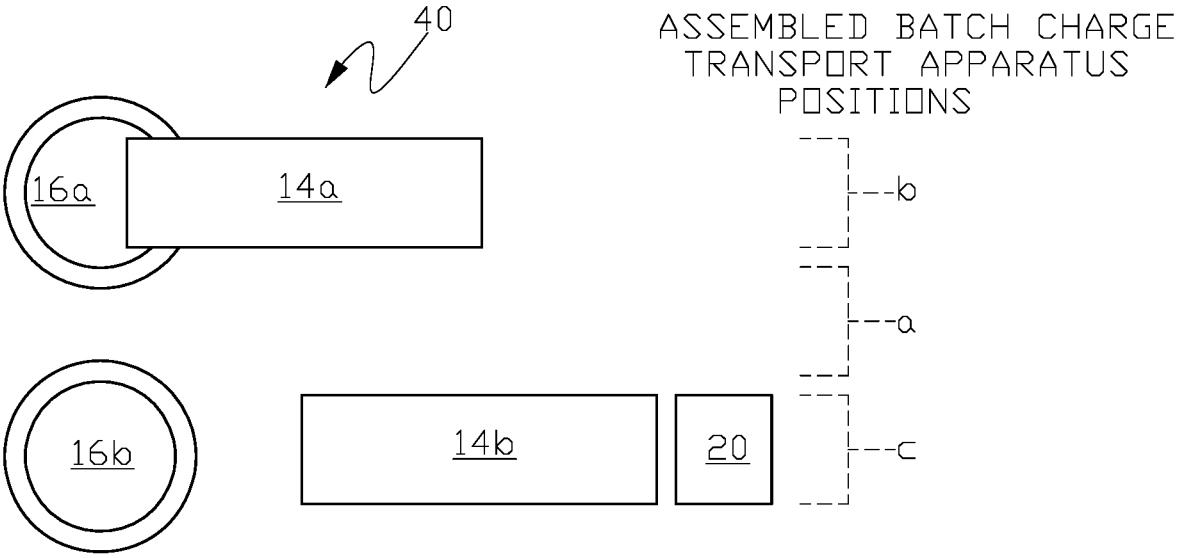
Figure 4E:
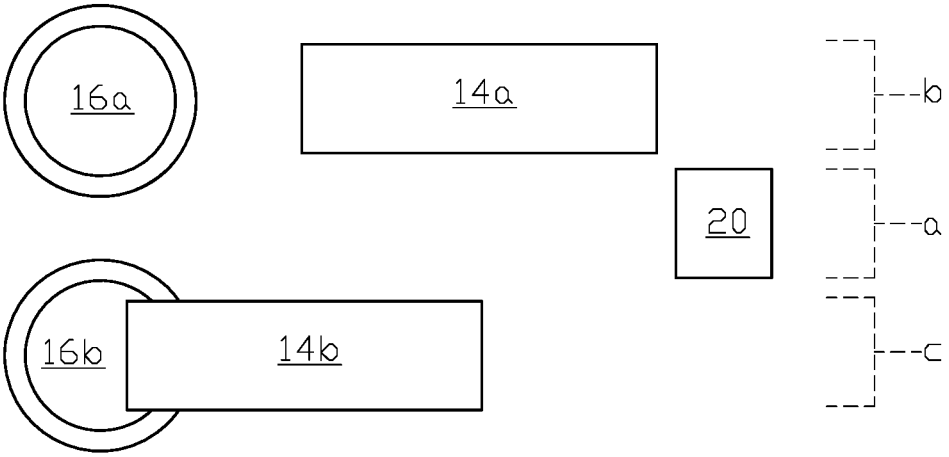

FIG. 4(*a*) through FIG. 4(*e*) illustrate one example of a batch charge conveying system 40 of the present invention for two or more electric induction furnaces. Although the embodiment of the invention in the figures is for two electric induction furnaces, other embodiments of the invention comprise batch charge conveying systems for more than two furnaces where the object is to optimize process time with repeated process cycles of: delivering an assembled batch charge to each furnace; melting the charge and melt heating in each furnace; and drawing the melt from each furnace where the batch charge conveying system utilizes a single assembled batch charge transport apparatus for delivering the assembled batch charge to each furnace.

In FIG. 4(*a*) a single assembled batch charge transport apparatus 20 is positioned between two charge conveying apparatus 14*a* and 14*b*. Charge conveying apparatus 14*a* is adjacent to batch charge loading station "a" with conveying apparatus 14*a* provided to supply an assembled batch charge to electric induction furnace 16*a* and with charge conveying apparatus 14*b* provided to supply an assembled batch charge to electric induction furnace 16*b*. In this embodiment of the invention a single batch charge loading station "a" for assembled batch charge transport apparatus 20 is located separate from conveying apparatus batch charge loading stations "b" and "c" for conveying apparatus 14*a* and 14*b* respectively. Selected charge materials are delivered to batch charge loading station "a" by a suitable material handling and transfer apparatus, for example, a charge material conveyor upon which measured portions of different charge materials are deposited at different charge material storage stations and transferred to assembled batch charge transport apparatus 20 at loading station "a" to form an assembled batch charge on the assembled batch charge transport apparatus.

In FIG. 4(*a*) both conveying apparatus 14*a* and 14*b* are shown in the retracted position (withdrawn from furnaces 16*a* and 16*b* respectively) with their right ends (14*a*" and 14*b*") adjacent to conveyor charge loading stations "b" and "c" respectively where the assembled batch charge on assembled batch charge transport 20 can be selectively transferred to the right end of either conveyor apparatus 14*a* or 14*b* when the assembled batch charge transport is moved from charge loading station "a" to either conveyor charge loading station "b" or "c" respectively.

After the assembled batch charge load is transferred and loaded on assembled batch charge transport station 20 in FIG. 4(*a*), assembled batch charge transport apparatus 20 selectively moves to conveyor charge loading station "b" in FIG. 4(*b*) and the assembled batch charge on the assembled batch charge transport station 20 is transferred to charge conveying apparatus 14*a*, which is in the conveyor charge load position at loading station "b", while in FIG. 4(*b*) a previously assembled batch charge on the assembled batch charge transport 20 has been transferred to conveyor apparatus 14*b* and the conveyor apparatus 14*b* has moved to the furnace charge load position to load another previously assembled batch charge into the crucible of furnace 16*b*.

Transfer of the assembled batch charge on assembled batch charge transport apparatus 20 to conveying apparatus 14*a* or 14*b* can be accomplished by a transfer means such as a power driven belt or a vibratory transfer table on the assembled batch charge transport apparatus or a power driven hinged open-box bed on the transport apparatus that dumps the assembled batch charge onto the selected charge conveying apparatus.

After a previously assembled batch charge has been melted, heated to a required melt temperature and drawn from furnace 16*a*, conveying apparatus 14*a* with the assembled batch charge loaded in FIG. 4(*b*) moves from the retracted conveyor position to the furnace charge load position for loading of the assembled batch charge into the crucible of furnace 16*a* as show in FIG. 4(*c*) while charge conveyor apparatus 14*b* moves from the furnace charge load position in FIG. 4(*b*) to the retracted conveyor position adjacent to conveyor charge load station "c" as shown in FIG. 4(*c*) and empty (unloaded) assembled batch charge transport apparatus 20 moves to batch charge loading station "a" as shown in FIG. 4(*c*).

After the assembled batch charge load is transferred and loaded on assembled batch charge transport apparatus 20 in FIG. 4(*c*), assembled batch charge assembly station 20 selectively moves to conveyor charge loading station "c" in FIG. 4(*d*) and the assembled batch charge on the assembled batch charge transport station 20 is transferred to charge conveying apparatus 14*b*, which is in the conveyor charge load position at station "c" as shown in FIG. 4(*d*).

In FIG. 4(*e*) after the previously assembled batch charge has been melted, heated to a required melt temperature and drawn from furnace 16*b* in FIG. 4(*d*), conveying apparatus 14*b* with the assembled batch charge loaded in FIG. 4(*d*) moves from the retracted conveyor position to the furnace charge load position to load the assembled batch charge load into the crucible of furnace 16*b* as show in FIG. 4(*e*) to begin a new batch melt while conveyor apparatus 14*a* moves from the furnace charge load position to the retracted conveyor position adjacent to load station "c" and empty (unloaded) assembled batch charge transport apparatus 20 moves to batch charge loading station "a".

In one embodiment of the invention the apparatus and process described in FIG. 4(*a*) to FIG. 4(*e*) can be sequentially repeated after the apparatus and process shown in FIG. 4(*e*) by returning to the apparatus and process described sequentially from FIG. 4(*b*) through FIG. 4(*e*). With the batch charge conveying system of the present invention a single assembled batch charge transport apparatus 20 is used to optimize process time and efficiency by transferring an assembled batch charge to a charge conveyor apparatus associated with a furnace that is completing the melting and drawing process cycles while other furnaces in the system are beginning or are in the melting and drawing process cycles.

Movement and repositioning of the single assembled batch charge transport apparatus 20 in all embodiments of the invention, for example, between loading stations "a", "b" and "c" in FIG. 4(*a*) through FIG. 4(*e*), can be accomplished by an assembled batch charge transport driver, for example, a wheelset (wheel-axle assembly) attached to the single assembled batch charge transport apparatus where the wheels move over rails installed at ground level or in structure associated with supporting material handling equipment.

Summarizing one embodiment of the invention, the batch charge conveying system for two or more electric induction furnaces has a separate charge conveying apparatus for conveying an assembled batch charge to each one of the two or more electric induction furnaces with the separate charge conveying apparatus having an assembled batch charge receiving end and an assembled batch charge furnace delivery end. A single assembled batch charge transport apparatus receives selected charge materials forming the assembled batch charge on the single assembled batch charge transport apparatus. The single assembled batch charge transport apparatus has an assembled batch charge transport driver arranged to move the single assembled batch charge transport apparatus with the assembled batch charge to a separate conveying apparatus batch charge load station adjacent to the assembled batch charge receiving end of a selected one of the separate charge conveying apparatus for transfer of the assembled batch charge to the selected one of the separate charge conveying apparatus.

In all embodiments of the invention selection of the order in supplying the assembled batch charge to a furnace's charge conveying apparatus can be made by a furnace control system based upon where in the process cycle of loading charge; melting charge; melt heating and drawing each furnace in a particular multiple furnace system; a furnace in a multiple furnace that is finishing the drawing of the melt from the furnace generally has the highest priority for delivery of an assembled batch charge for the next batch process of induction melting, heating and drawing of melt from the furnace as known in the art.

Figure 5A:
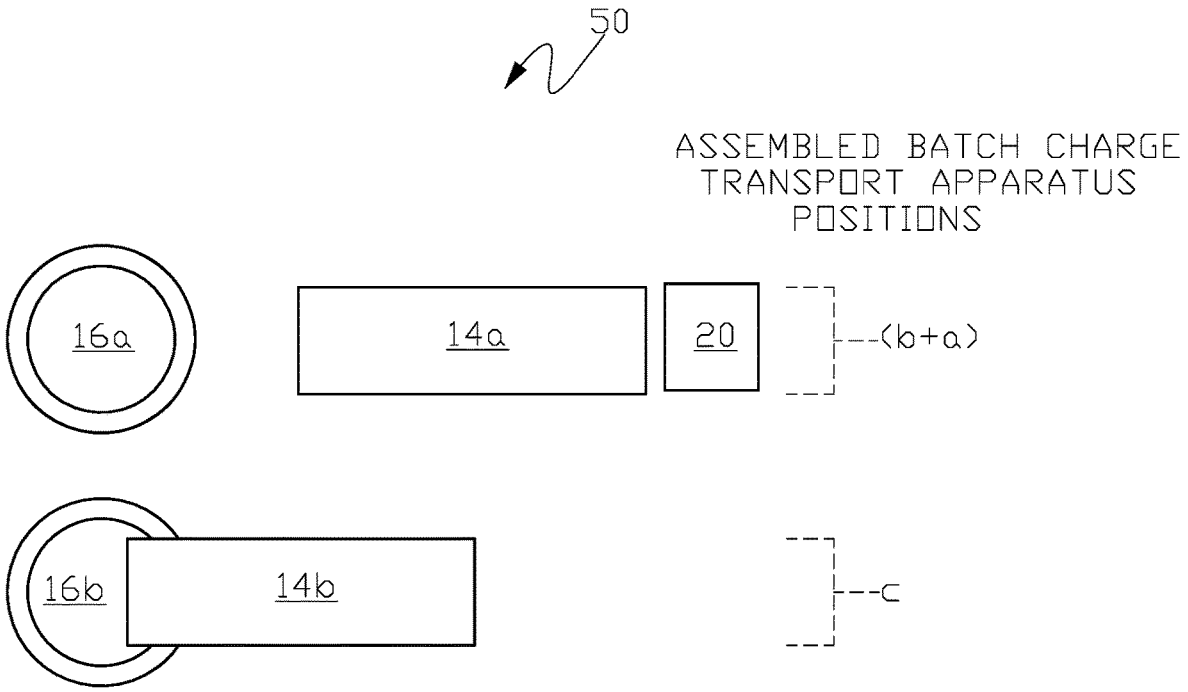
FIG. 5(*a*) and FIG. 5(*b*) diagrammatically illustrate another example of a batch charge conveying system of the present invention where a single assembled batch charge transfer apparatus selectively supplies an assembled batch charge to any one of two induction furnaces.
Figure 5B:
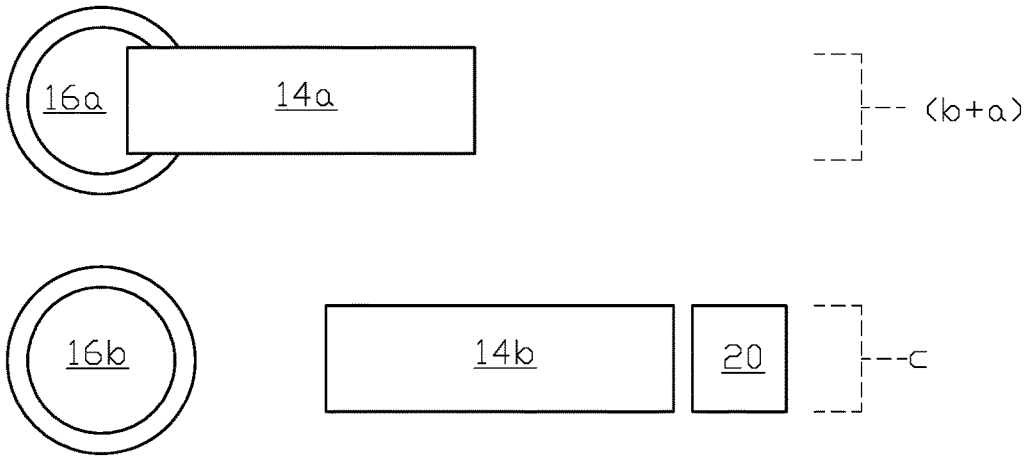

FIG. 5(*a*) and FIG. 5(*b*) illustrate another embodiment of the invention where the single batch load charge loading station "a" in FIG. 4(*a*) through FIG. 4(*e*) is integrated into at least one of the charge conveying apparatus batch loading stations "b" and "c" as illustrated by reference sign (b+a) in FIG. 5(*a*) and FIG. 5(*b*) so that as shown in FIG. 5(*a*) assembled batch charge transport apparatus 20 can be loaded with an assembled batch charge at loading station (b+a) and then selectively transfer the assembled batch charge to charge conveying apparatus 14*a* for delivery to electric induction furnace 16*a* at the same loading station (b+a) or move to loading station "c" and transfer the assembled batch charge to conveying apparatus 14*b* for delivery to electric induction furnace 16*b*.

The process of the present invention can also be used in an arrangement of three or more induction furnaces where the single assembled batch charge transport apparatus moves among multiple charge conveying apparatus dedicated to each of the three or more induction furnaces to deliver an assembled batch charge to a selected one of the multiple charge conveying apparatus while the furnaces associated with the other multiple charge conveying apparatus perform process steps associated with inductively heating, melting and/or drawing molten material from the furnaces.

In another embodiment of the invention a method of conveying a selected assembled batch furnace charge from a single assembled batch charge transport apparatus to a selected one of a separate charge conveying apparatus for each one of a plurality of electric induction furnaces is provided. In this embodiment the method the sequentially performed steps include:

(a) positioning the single assembled batch charge transport apparatus adjacent to a batch charge receiving end of the selected one of the separate charge conveying apparatus;

(b) transferring the selected assembled batch furnace charge on the single assembled batch charge transport apparatus to the batch charge receiving end of the selected one of the separate charge conveying apparatus;

(c) processing an inputted change in the selected assembled batch furnace charge and an inputted change in the selected one of the separate charge conveying apparatus in a furnace batch conveyor control system;

(d) loading the selected assembled batch furnace charge processed in step (c) on the single assembled batch charge transport apparatus;

(e) positioning the single assembled batch charge transport apparatus to an assembled batch charge delivery station adjacent to the batch charge receiving end of the selected one of the separate charge conveying apparatus processed in step (c);

(f) transferring the selected assembled batch furnace charge processed in step (c) on the single assembled batch charge transport apparatus to the batch charge receiving end of the selected one of the separate charge conveying apparatus processed in step (c); and (g) sequentially repeating steps (c) through (f) to convey the selected assembled batch furnace charge from a single assembled batch charge transport apparatus to the selected one of the separate charge conveying apparatus for each one of a plurality of electric induction furnaces.

In the description above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A batch charge conveying system for two or more electric induction furnaces with each of the two or more electric induction furnaces having a furnace crucible, the batch charge conveying system comprising:

a charge material conveyor for a deposit of a measured portions of a plurality of different charge materials located at a plurality of different charge material storage locations;

a separate charge conveying apparatus for conveying an assembled batch charge to each one of the two or more electric induction furnaces, the separate charge conveying apparatus having a conveying charge load end and a furnace charge load end, the separate charge conveying apparatus having a furnace charge load retracted position and a furnace charge load position, the furnace charge load position configured for dumping the assembled batch charge from the furnace charge load end into the furnace crucible of one of the two or more electric induction furnaces;

a single assembled batch charge transport apparatus for receiving the measured portions of the plurality of different charge materials from the charge material conveyor to form the assembled batch charge on the single assembled batch charge transport apparatus, the single assembled batch charge transport apparatus having an assembled batch charge transport driver system arranged to move the single assembled batch charge transport apparatus with the assembled batch charge to a conveyor charge loading station adjacent to the conveying charge load end of one of the separate charge conveying apparatus when the one of the separate charge conveying apparatus is in the furnace charge load retracted position for transfer of the assembled batch charge to the one of the separate charge conveying apparatus; and a furnace control system controlling a selection of the order in supplying the assembled batch charge to one of the separate charge conveying apparatus.

2. The batch charge conveying system for two or more electric induction furnaces of claim 1 further comprising a single batch charge loading station for the single assembled batch charge transport apparatus to receive the measured portions of the plurality of different charge materials from the charge material conveyor, the assembled batch charge transport driver system arranged to move the single assembled batch charge transport apparatus between the single batch charge loading station and the conveyor charge loading station for each of the separate charge conveying apparatus.

3. The batch charge conveying system for two or more electric induction furnaces of claim 1 further comprising a batch charge loading station for the single assembled batch charge transport apparatus collocated with the conveyor charge loading station for at least one of the separate charge conveying apparatus.

4. The batch charge conveying system for two or more electric induction furnaces of claim 1 further comprising a means for moving the separate charge conveying apparatus between the furnace charge load retracted position for the transfer of the assembled batch charge from the single assembled batch charge transport apparatus to the separate charge conveying apparatus and the furnace charge load position for the transfer of the assembled batch charge from the separate charge conveying apparatus into the furnace crucible of the one of the two or more electric induction furnaces.

5. A method of conveying an assembled batch furnace charge to a furnace crucible for each separate one of a plurality of electric induction furnaces by a separate charge conveying apparatus associated with each one of the plurality of electric induction furnaces, the method comprising sequentially performing the following steps:

(a) depositing a measured portions of a plurality of different charge materials located at a plurality of different charge material storage locations on a charge material conveyor for a transfer of the plurality of different charge materials to form the assembled batch furnace charge on a single assembled batch charge transport apparatus at a batch charge loading station;

(b) moving the single assembled batch charge transport apparatus with the assembled batch furnace charge to a selected one of a separate batch charge loading station associated with each of the separate charge conveying apparatus;

(c) transferring the assembled batch furnace charge on the single assembled batch charge transport apparatus to a conveying charge load end of the separate charge conveying apparatus at the selected one of the separate batch charge loading station with the separate charge conveying apparatus in a furnace charge load retracted position to form an unloaded single assembled batch charge transport apparatus;

(d) moving the separate charge conveying apparatus at the selected one of the separate batch charge loading station to a furnace charge load position and dumping the assembled batch furnace charge from a furnace charge load end into the furnace crucible associated with the separate charge conveying apparatus at the selected one of the separate batch charge loading station; and (e) moving the unloaded single assembled batch charge transport apparatus to the batch charge loading station and sequentially repeating steps (a) through (d) at the remaining separate batch charge loading stations associated with each of the remaining separate charge conveying apparatus to optimize process time when repeatedly melting, melt heating, and melt drawing in each of the plurality of electric induction furnaces with charging each of the plurality of electric induction furnaces with the single assembled batch charge transport apparatus.

6. The method of claim 5 wherein the step of loading the assembled furnace batch charge is performed at one of the separate batch charge loading stations.

7. The method of claim 5 further comprising the step of vibratorily moving the assembled furnace batch charge from the conveying charge load end to the furnace charge load end of the separate charge conveying apparatus.

8. A batch charge conveying system for two or more electric induction furnaces with each of the two or more electric induction furnaces having a furnace crucible, the batch charge conveying system comprising:

a charge material conveyor for a deposit of a measured portions of a plurality of different charge materials located at a plurality of different charge material storage locations;

a separate charge conveying apparatus for conveying an assembled batch charge to each one of the two or more electric induction furnaces, the separate charge conveying apparatus having a conveying charge load end and a furnace charge load end, the separate charge conveying apparatus having a furnace charge load retracted position and a furnace charge load position, the furnace charge load position configured for dumping the assembled batch charge from the furnace charge load end into the furnace crucible of one of the two or more electric induction furnaces;

a single assembled batch charge transport apparatus for receiving the measured portions of the plurality of different charge materials from the charge material conveyor to form the assembled batch charge on the single assembled batch charge transport apparatus, the single assembled batch charge transport apparatus having an assembled batch charge transport driver system arranged to move the single assembled batch charge transport apparatus with the assembled batch charge to a conveyor charge loading station adjacent to the conveying charge load end of one of the separate charge conveying apparatus when the one of the separate charge conveying apparatus is in the furnace charge load retracted position for transfer of the assembled batch charge to the one of the separate charge conveying apparatus;

a means for moving the separate charge conveying apparatus between the furnace charge load retracted position for the transfer of the assembled batch charge from the single assembled batch charge transport apparatus to the separate charge conveying apparatus and the furnace charge load position for the transfer of the assembled batch charge from the separate charge conveying apparatus into the furnace crucible of the one of the two or more electric induction furnaces; and a furnace control system controlling a selection of the order in supplying the assembled batch charge to one of the separate charge conveying apparatus.

9. The batch charge conveying system for two or more electric induction furnaces of claim 8 wherein the separate charge conveying apparatus comprises a vibratory conveyor.

* * * * *